US007273378B2

(12) United States Patent
Nishio et al.

(10) Patent No.: US 7,273,378 B2
(45) Date of Patent: Sep. 25, 2007

(54) CONNECTING DEVICE

(75) Inventors: Atsushi Nishio, Tokyo (JP); Takashi Kawasaki, Tokyo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 145 days.

(21) Appl. No.: 10/880,085

(22) Filed: Jun. 30, 2004

(65) Prior Publication Data

US 2005/0064741 A1 Mar. 24, 2005

(30) Foreign Application Priority Data

Sep. 19, 2003 (JP) ..... P.2003-328726
Sep. 19, 2003 (JP) ..... P.2003-328728

(51) Int. Cl.
*H01R 12/00* (2006.01)

(52) U.S. Cl. ..... 439/65; 439/66; 439/74

(58) Field of Classification Search ..... 439/65, 439/66, 74, 862
See application file for complete search history.

(56) References Cited

U.S. PATENT DOCUMENTS 3,492,538 A * 1/1970 Fergusson ..... 439/61
3,529,213 A * 9/1970 Farrand et al. ..... 439/74
3,805,117 A * 4/1974 Hausman ..... 439/74
4,245,876 A * 1/1981 Ritchie et al. ..... 439/65
4,250,536 A * 2/1981 Barringer et al. ..... 439/74
4,688,864 A 8/1987 Sorel
4,806,105 A * 2/1989 Muzslay ..... 439/74
5,000,690 A * 3/1991 Sonobe et al. ..... 439/74
5,026,290 A * 6/1991 Dery ..... 439/65
5,484,295 A * 1/1996 Mowry et al. ..... 439/66
5,910,885 A * 6/1999 Gulachenski et al. ..... 439/65
2002/0160632 A1 10/2002 Maldonado et al.

FOREIGN PATENT DOCUMENTS

GB 2 348 320 9/2000
JP 57-43585 3/1982
JP 2000-260507 9/2000

OTHER PUBLICATIONS

European Search Report dated Dec. 27, 2004.

* cited by examiner

*Primary Examiner*—Tho D. Ta
(74) *Attorney, Agent, or Firm*—Whitham, Curtis, Christofferson & Cook, PC

(57) ABSTRACT

A connecting device includes a first circuit board having a first conductive pattern on an outer peripheral edge portion thereof, a second circuit board having a second conductive pattern on an outer peripheral edge portion thereof, and a connector having a terminal corresponding to the first and second conductive patterns. The terminal connects the first conductive pattern and the second conductive pattern when the first and second circuit boards are attached to the connector. Also, a connecting device includes a first circuit board having a first conductive pattern on an edge portion thereof, a second circuit board having a second conductive pattern on an edge portion thereof, and a connector having a first and second faces, the first and second faces have a first and second recess portions respectively. A terminal connects the first and second conductive patterns when the first and second circuit boards are attached to the first and second recess portions respectively.

13 Claims, 9 Drawing Sheets

CONNECTING DEVICE

BACKGROUND OF THE INVENTION

This invention relates to a connecting device, and more particularly to a connecting device for circuit boards in which an assembling process is simplified by obviating the need for a soldering operation.

Also, this invention relates to a connecting device, and more particularly to a connecting device for circuit boards which enables the design of circuits to be made easily.

In a related connecting device for circuit boards shown in FIGS. 12 to 16, patterns 2 are printed on one aide portion of one circuit board 1, and terminals 4 of a female-type connector 3 are soldered respectively to the patterns 2, so that this connector is fixed to the circuit board. Like the circuit board 1, patterns 6 are provided at one side portion of the other circuit board 5, and terminals 8 or a male-type connector 7 are soldered respectively to the patterns 6, so that the male-type connector 7 is fixed to the circuit board 5.

When the male-type connector 7 is fitted into the female-type connector 3, the one circuit board 1 and the other circuit board 5 are electrically connected together (see, for example, JP-A-2000-260507).

In JP-A-2000-260507, the male-type connector 7 and the female-type connector 3, mounted respectively on the associated circuit boards 1 and 5 by soldering, are fitted together. As a result, the two circuit boards 1 and 5 can be electrically connected together. However, since these connectors 3,7 are mounted respectively on the associated circuit boards 1 and 5 by soldering, the assembling operation is complicated, and this has lowered the efficiency of the circuit board-mounting operation.

Also, in JP-A-2000-260507, each of the male-type connector 7 and the female-type connector 3 is soldered to the patterns formed in a concentrated manner on the one aide portion of the corresponding circuit board, and by fitting the male-type connector 7 and the female-type connector 3 together, the circuit boards 1 and 5 can be electrically connected together. However, the patterns must be formed in a concentrated manner at the one side portion or each circuit board, the design of the circuits has been much limited.

SUMMARY OF THE INVENTION

It is therefore a first object of the present invention to provide a connecting device for circuit boards capable of simplifying the assembling operation required for connecting the circuit boards, thus enhancing operation efficiency.

Also, a second object of the present invention is to provide a connecting device for circuit boards capable of simplifying the design of the circuit boards, thus enhancing operation efficiency.

In order to achieve the above object, according to the present invention, there is provided a connecting device, comprising:

a first circuit board, which has a first conductive pattern on an edge portion thereof;

a second circuit board, which has a second conductive pattern on an edge portion thereof; and a connector, which includes a first face and a second face opposed to the first face, the first face and second face having a first reels portion and a second recess portion respectively, wherein a terminal is provided in the first and second recess portion; and wherein the terminal connects the first conductive pattern and the second conductive pattern when the first circuit board and the second circuit board are attached to the first recess portion and the second recess portion respectively.

Preferably, each of the first recess portion and the second recess portion has at least two sides. A plurality of the terminals of the connector are arranged along the at least two sides.

Preferably, the connector has a step portion which prevents the insertion of the first and second circuit boards in a reverse state to the first and second recess portions.

Preferably, a thickness of each of the first and second recess portion is greater than that of each of the first and second circuit boards.

Preferably, each of the first and second circuit boards have two linear sides which face each other and curved sides which are connected to the linear sides.

Preferably, the connector has a fixing member which fixes the first and second circuit boards to the connector.

Preferably, the fixing member is provided as a cover member. The cover member is slidably provided on an end portion of the connector. The cover member slides between an open position and a closed position. When the cover member is positioned at the open position, the cover member allows the first and second circuit boards to attach to the connector. When the cover member is positioned at the closed position when the first and second circuit board are mounted on the connector, the cover member fixes the first and second circuit boards to the connector.

Preferably, the cover member covers the first and second conductive patterns of the first and second circuit boards when the cover member is positioned at the closed position.

In the above configurations, the recess portions, corresponding in shape to the circuit boards to which the connector is connected, are formed respectively in the front and back sides of the connector, and these recess portions are formed so that the circuit boards can be fixed to the recess portions, respectively. The conductive patterns are provided at the outer edge portion of each of the circuit boards so as to be press-contacted respectively with the terminals mounted at the recess portions of the connector.

Therefore, when the circuit boards are fixed to the recess portions of the connector, the circuit boards, provided respectively at the opposite (front and back) sides of the connector, are electrically connected together via the terminals of the connector. Therefore, the soldering operation for soldering each connector to the corresponding circuit board and the positioning operation for the purpose of fining the male-type and female-type connectors together as in the related construction are not necessary. This results in enhanced efficiency of assembling operation for electrically connecting the circuit boards. Further, labor costs are reduced, thus contributing to the overall reduction of cost.

According to the present invention, there is also provided a connecting device comprising:

a first circuit board, which has a first conductive pattern on an outer peripheral edge portion thereof;

a second circuit board, which has a second conductive pattern on an outer peripheral edge portion thereof; and a connector, which has a terminal corresponding to the first and second conductive patterns, wherein the terminal connects the first conductive pattern and the second conductive pattern when the first circuit board and the second circuit board are attached to the connector.

In the above configuration, the conductive patterns are provided at the outer peripheral edge portion of each of the first and second circuit boards, and these patterns can be press-contacted with the terminal of the connector, respectively. Therefore, as compared with the related construction in which the patterns are formed in a concentrated manner at the one side portion of each circuit board, the degree of freedom of the circuit design is enhanced, so that the circuit boards can be simplified, thus contributing to the reduction of the cost. In addition, because the edge portion of each circuit board is utilized, a small-size design of the circuit boards can be achieved.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Figure 1:
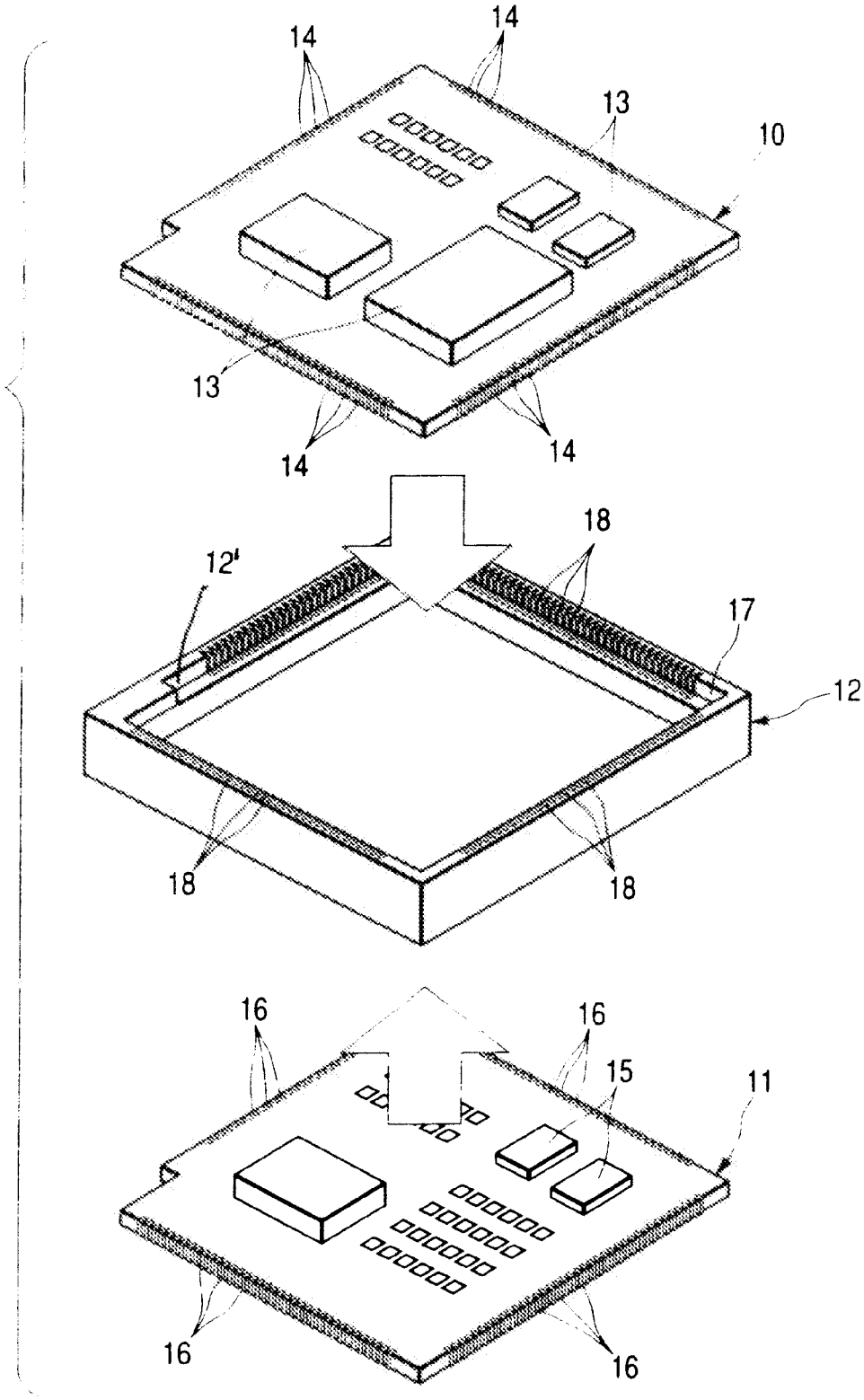
FIG. 1 is an exploded, perspective view of a connection device for circuit boards according a first embodiment of the present invention.
Figure 2:
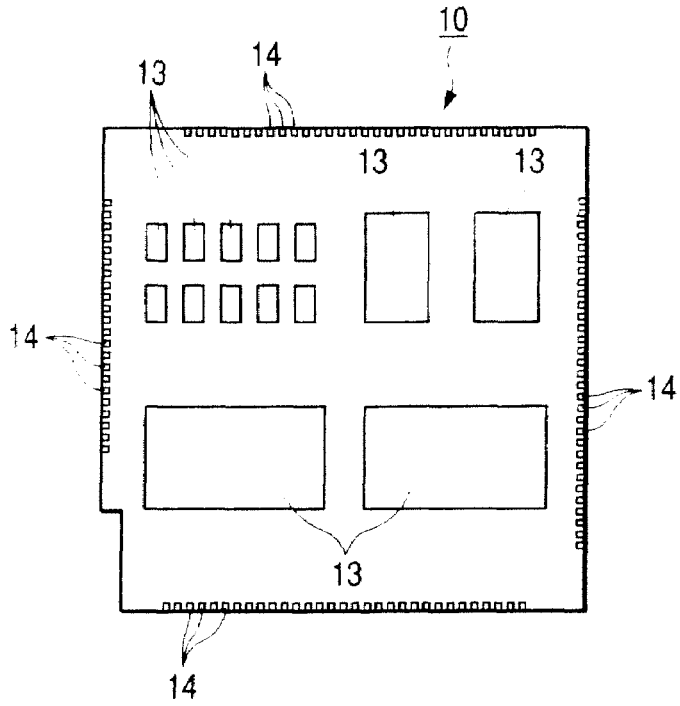
FIG. 2 is a plan view or a first circuit board.
Figure 3:
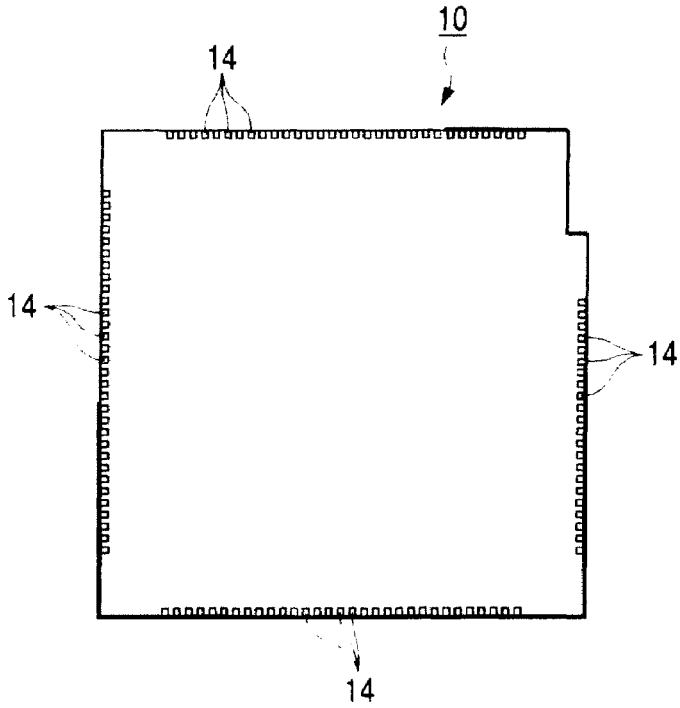
FIG. 3 is a view showing a back side of the first circuit board.

Preferred embodiments of the present invention will now be described in detail with reference to FIGS. 1 to 11. FIG. 1 is an exploded, perspective view of an assembly including a first circuit board 10, a second circuit board 11 and a connector 12 of the first embodiment. Various electronic components 13 are mounted on the first circuit board 10. Also, wiring is provided on the first circuit board 10. As shown in FIGS. 1 to 3, patterns 14 are provided at outer edge portions of the first circuit board 10.

Figure 4:
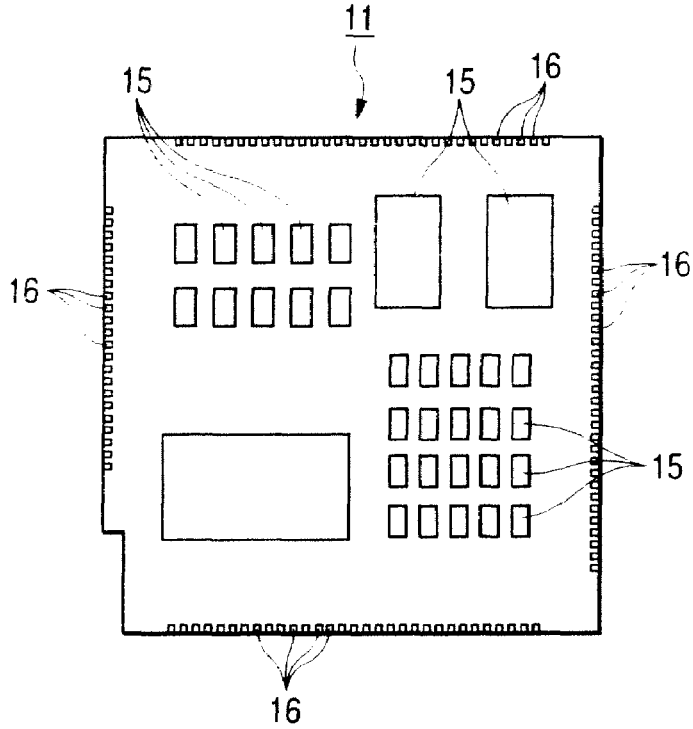
FIG. 4 is a plan view of a second circuit board.
Figure 5:
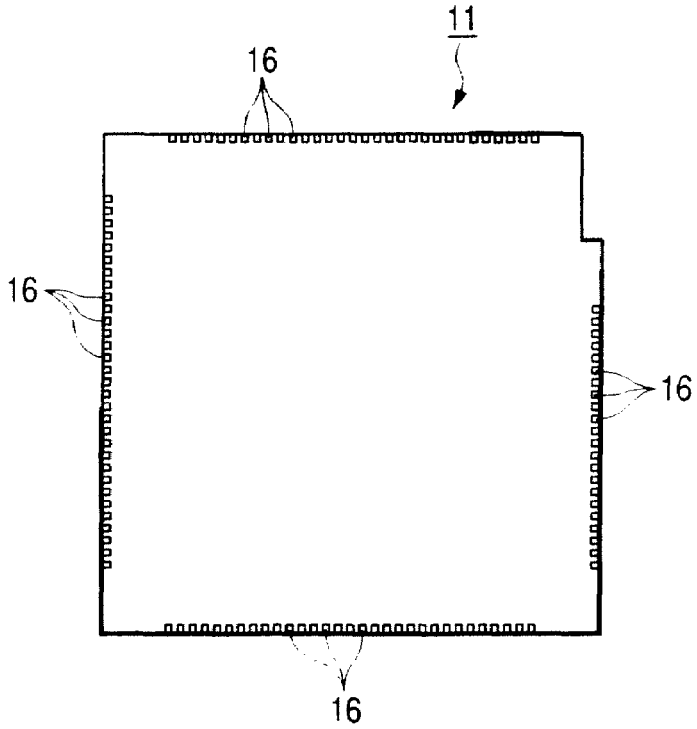
FIG. 5 is a view showing a back side of the second circuit board.

Like the first circuit board 10, various electronic components 15 are mounted on the second circuit board 11 and also, patterns 16 are provided at outer edge portions of the second circuit board 11 as shown in FIGS. 1, 4 and 5.

Figure 6:
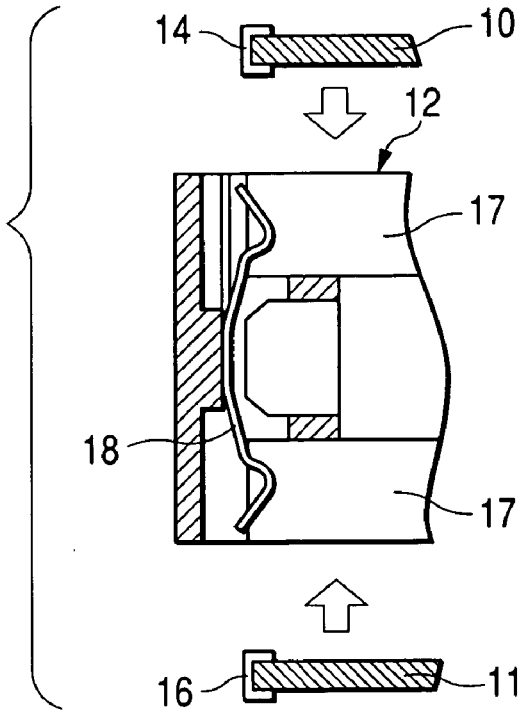
FIG. 6 is an enlarged, vertical cross-sectional view of an important portion, showing the manner or fixing the first and second circuit boards to a connector.
Figure 7:
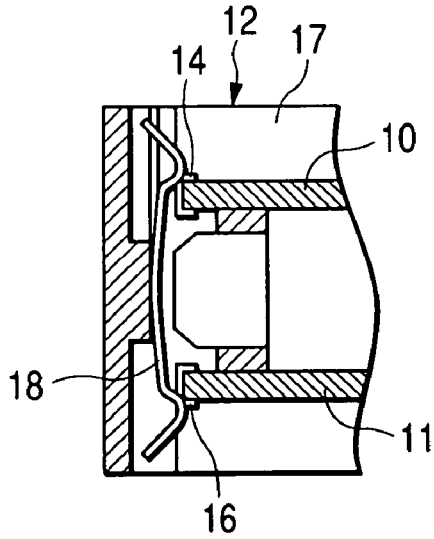
FIG. 7 is an enlarged, vertical cross-sectional view of the important portion, showing a condition in which the first and second circuit boards are fixed to the connector.
Figure 8:
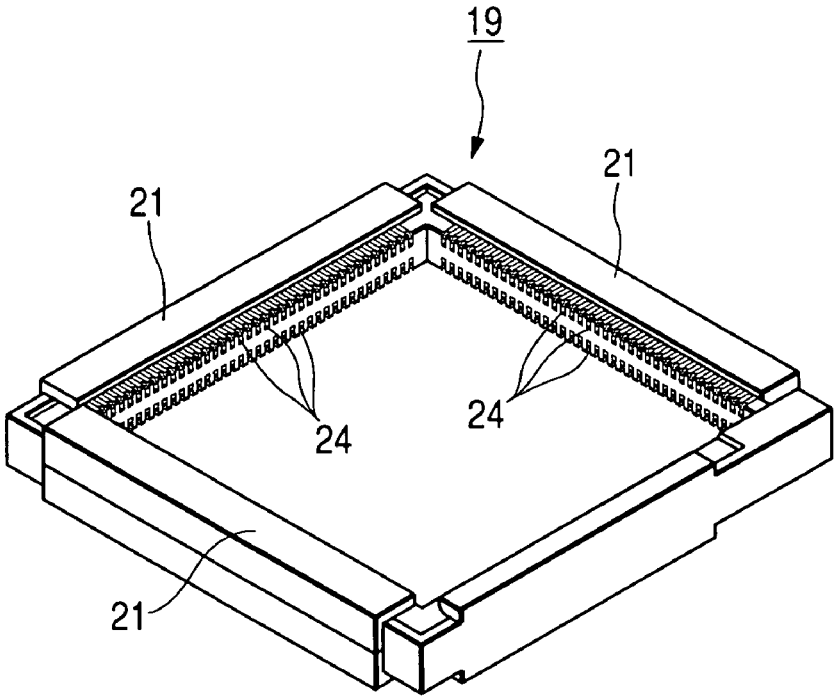
FIG. 8 is a perspective view showing a connector according to a second embodiment of the present invention.

On the other hand, the connector 12 is made of a synthetic resin, and recess portions 17 are formed respectively in front and back (opposite) sides of the connector as shown in FIGS. 1, 6 and 7. The recess portions 17 are generally equal in shape to the outer peripheral edge of the first and second circuit boards 10 and 11, and the first and second circuit boards 10 and 11 can be fixed to the recess portions 17, respectively. A step portion 12' is formed on one side of the connector 12 to prevent the insertion of the first and second circuit boards 10, 11 in an incorrect direction. Terminals 18 are mounted on an outer peripheral edge portion of the connector 12, and extend through the upper and lower recess portions 17.

For electrically connecting the first circuit board 10 and the second circuit board 11 together, the first and second circuit boards 10 and 11 are fitted respectively into the upper and lower recess portions 17 of the connector 12, and are fixed thereto. At this time, the patterns 14 on the first circuit board 10, as well as the patterns 16 on the second circuit board 11, are press-contacted with the terminals 18 of the connector 12, respectively, so that the first circuit board 10 and the second circuit board 11 are electrically connected together. Therefore, the step of soldering the connector 12 to the first and second circuit board 10 and 11 as in the related structure is not necessary. It is further unnecessary to position the first circuit board 10 and the second circuit board 11 relative to each other. Therefore, the assembling operation is simplified so that the required labor can be reduced, thus contributing to the reduction of the cost.

Also, the patterns 14 are provided at the outer peripheral edge portion of the first circuit board 10, while the patterns 16 are provided at the outer peripheral edge portion of the second circuit board 11. Therefore, as compared with the related construction in which the patterns are provided in a concentrated manner at one side portion of each of the circuit boards, limitations on the design of the first and second circuit boards 10 and 11, are eliminated. Therefore, the design of the first and second circuit boards 10 and 11 can be simplified, thus contributing to a small-size design of the first and second circuit boards 10 and 11.

Figure 9:
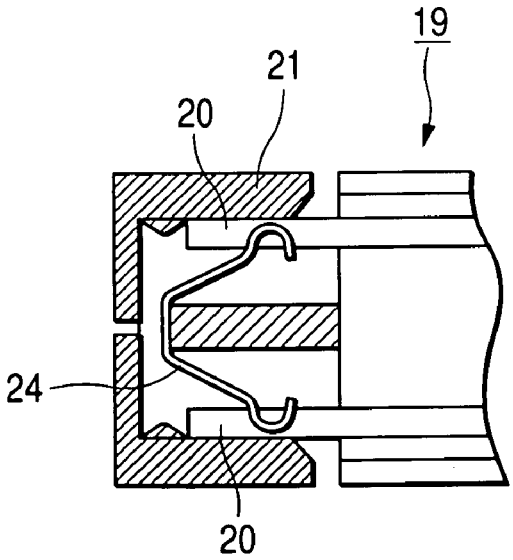
FIG. 9 in an enlarged, vertical cross-sectional view of an important portion of the second embodiment.
Figure 10:
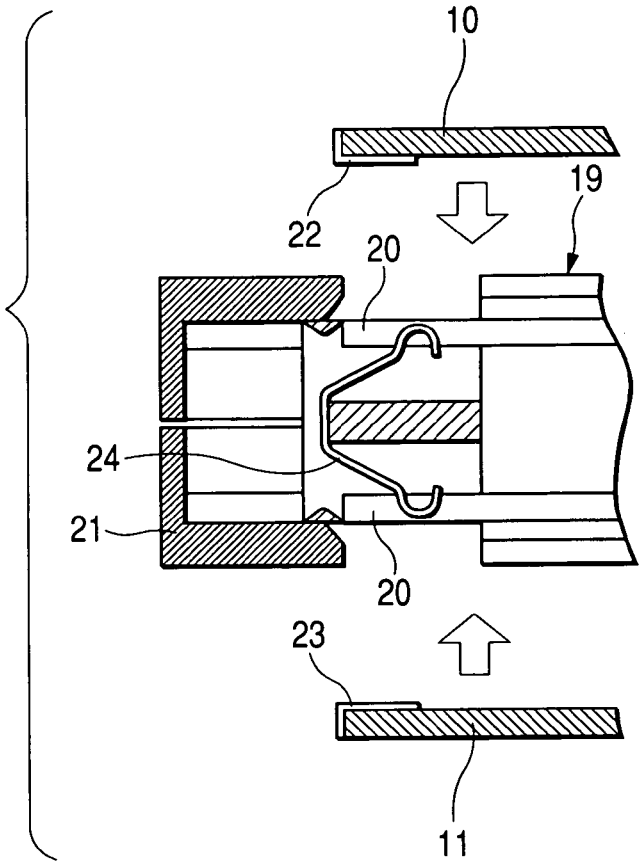
FIG. 10 is an enlarged, vertical cross-sectional view of an important portion or the second embodiment, showing the manner of fixing circuit boards to the connector.
Figure 11:
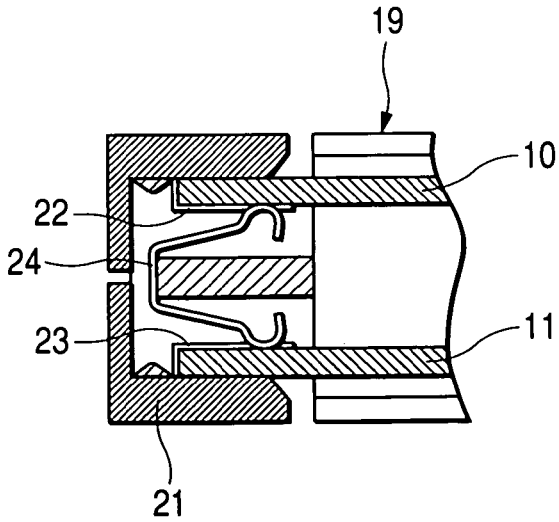
FIG. 11 is an enlarged, vertical cross-sectional view of the important portion of the second embodiment, showing a condition in which the first and second circuit boards are fixed to the connector.
Figure 12:
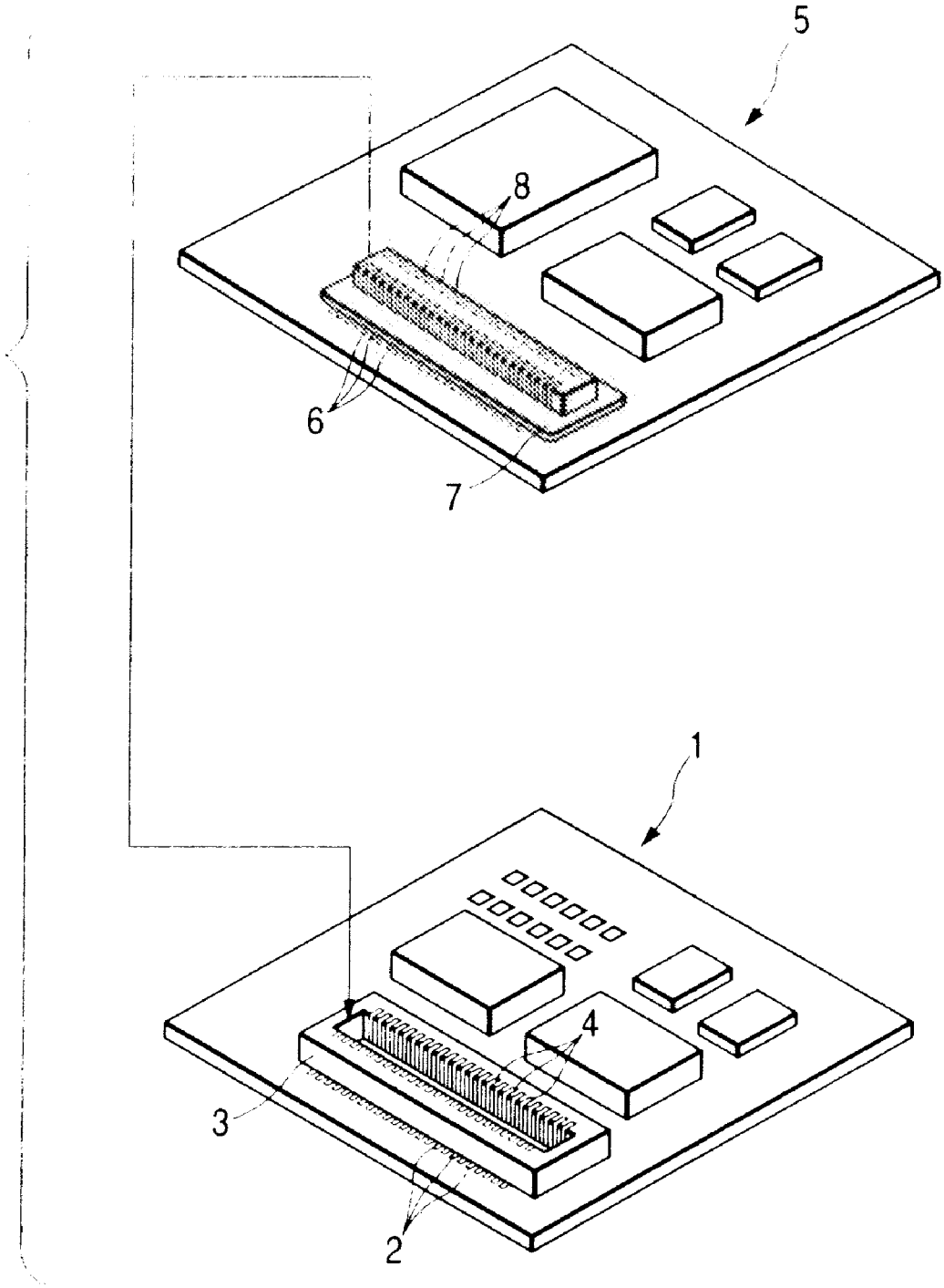
RELATED ART FIG. 12
FIG. 12 is an exploded, perspective view of a related connecting device for the circuit board.
Figure 13:
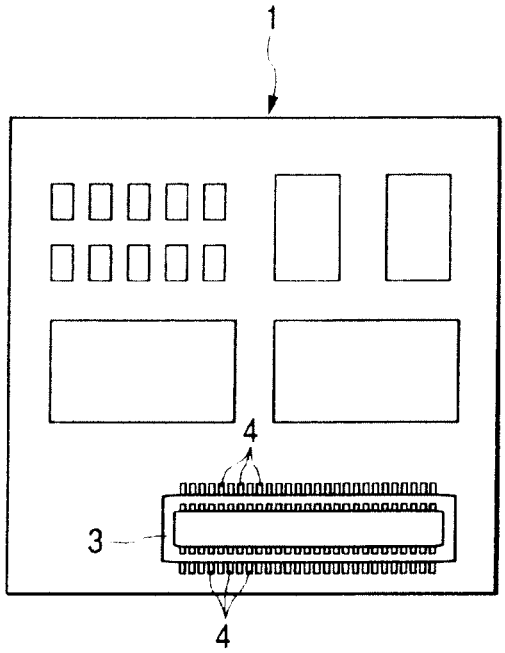
RELATED ART FIG. 13
FIG. 13 is a plan view of a circuit board of the related device.
Figure 14:
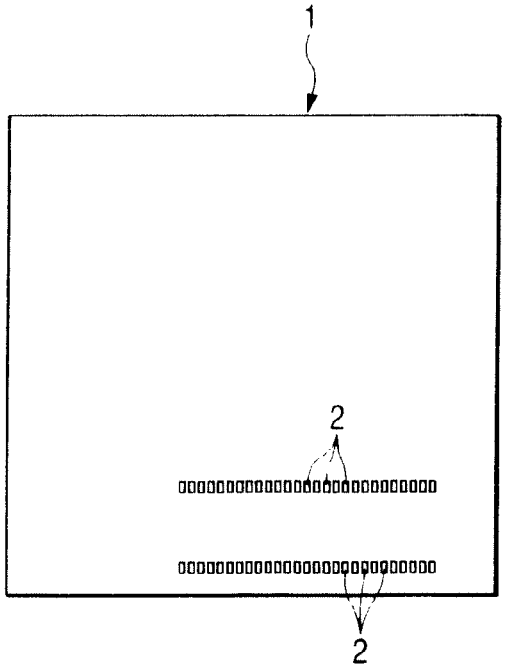
RELATED ART FIG. 14
FIG. 14 is a view showing a back side of the circuit board of the related device.
Figure 15:
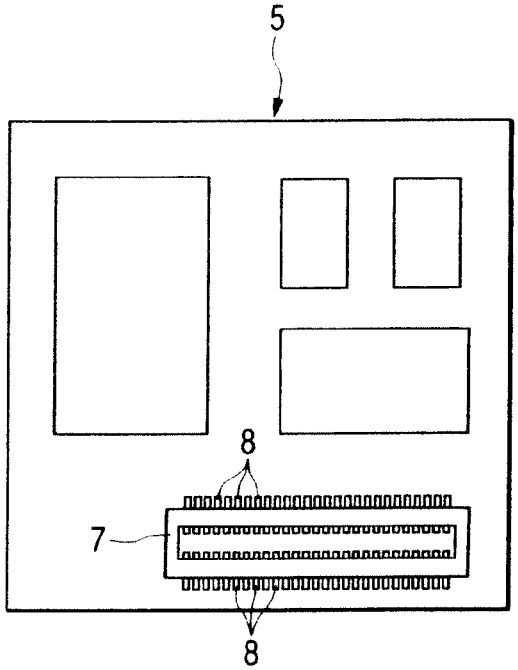
RELATED ART FIG. 15
FIG. 15 is a plan view of the other circuit board of the related device.
Figure 16:
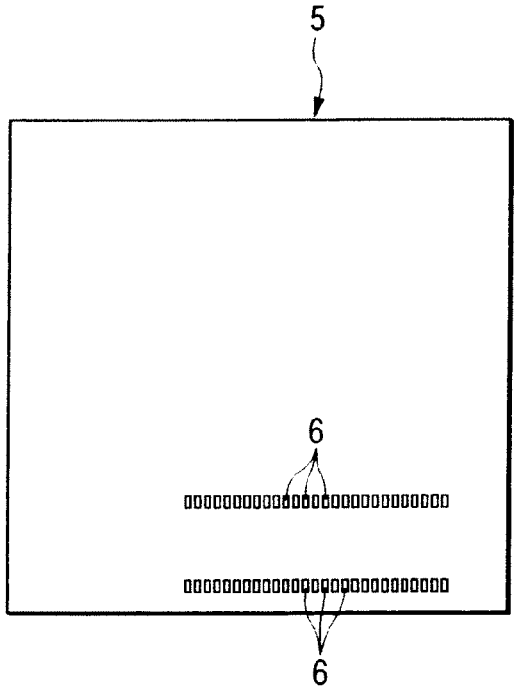
RELATED ART FIG. 16
FIG. 16 in a view showing a back side of the other circuit board of the related device.

Next, FIGS. 8 to 11 show the second embodiment of the invention. In the embodiment, covers 21 are attached to a connector 19 so as to slide inwardly and outwardly (a sliding direction as shown in FIG. 9 to 11) on a peripheral edge portion of the connector 19. The covers 21 can open and close four side edge portions of each of recess portions 20 of the connector 19, respectively. For fixing the first and second circuit boards 10 and 11 to the connector, first, the covers 21 are opened. Then, the first and second circuit boards 10 and 11 are fitted in the recess portions 20, respectively, and the covers 21 are slid inwardly. As a result, each of the four side edge portions of each of the first and second circuit boards 10 and 11 is held between the edge portion of the connector 19 and a corresponding inner surface of the corresponding cover 21, and therefore the first and second circuit boards 10 and 11 are fixed to the connector 19.

At this time, patterns 22 on the first circuit board 10, as well as patterns 23 on the second circuit board 11, are press-contacted with terminals 24 of the connector 19, respectively, so that the first circuit board 10 and the second circuit board 11 are electrically connected together. In this embodiment, also, a soldering operation and an operation for positioning the first circuit board 10 and the second circuit board 11 relative to each other are not necessary as described above for the preceding embodiment. Therefore, the efficiency of the operation is enhanced, and labor required for the assembling operation is reduced, thus contributing to the reduction of the cost. Also, the design of a circuit board can be simplified, and this contributes to a small-size design of the circuit board.

In the present invention, various modifications can be made without departing from the spirits of the invention, and such modifications naturally fall within the scope or the invention.

What is claimed is:

1. A connecting assembly, comprising:

a first circuit board, which has a first conductive pattern on an outer peripheral edge portion thereof;

a second circuit board, which has a second conductive pattern on an outer peripheral edge portion thereof; and a connector having a first face and a second face opposite the first face, which has a terminal corresponding to the first and second conductive patterns and recesses in said first face and said second face, respectively, for receiving said first and second circuit boards therein, wherein the terminal is fixed to the connector and electrically connects the first conductive pattern and the second conductive pattern when the first circuit board and the second circuit board are positioned in said recesses by the terminal; and wherein a part of the terminal extends through said recesses.

2. A connecting assembly as in claim 1, wherein the terminal is in contact with the outer peripheral edge portion of the first circuit board and the outer peripheral edge portion of the second circuit board so as to position the first and second circuit boards in the first and second recess portions, respectively.

3. A connecting assembly, comprising:

a first circuit board, which has a first conductive pattern on an outer peripheral edge portion thereof;

a second circuit board, which has a second conductive pattern on an outer peripheral edge portion thereof; and a connector, which includes a first face and a second face opposed to the first face, the first face and second face having a first recess portion and a second recess portion for receiving said first circuit board and said second circuit board, respectively; and a terminal, a part of which extends through said first and second recess portion, wherein the terminal electrically connects the first conductive pattern and the second conductive pattern when the first circuit board and the second circuit board are attached to the first recess portion and the second recess portion respectively.

4. The connecting assembly, as set forth in claim 3, wherein each of the first recess portion and the second recess portion has at least two sides; and wherein a plurality of the terminals of the connector are arranged along the at least two sides.

5. The connecting assembly, as set forth in claim 3, wherein the connector has a step portion which prevents from insertion of the first and second circuit boards in a reverse state to the first and second recess portions.

6. The connecting assembly, as set forth in claim 3, wherein a thickness of each of the first and second recess portion is greater than that of each of the first and second circuit boards.

7. A connecting assembly as in claim 3, farther comprising a cover member, slidably attached to the connector and operable to fix the first and second circuit boards to the first and second recess portions, respectively.

8. The connecting assembly, as set forth in claim 3, wherein the connector has a fixing member which fixes the first and second circuit boards to the connector.

9. The connecting assembly, as set forth in claim 8, wherein the fixing member is provided as a cover member;

wherein the cover member is slidably provided on an end portion of the connector;

wherein the cover member slides between an open position and a closed position;

wherein when the cover member is positioned at the open position, the cover member allows the first and second circuit boards to attach to the connector; and wherein when the cover member is positioned at the closed position when the first and second circuit board are mounted on the connector, the cover member fixes the first and second circuit boards to the connector.

10. The connecting assembly, as set forth in claim 9, wherein the cover member covers the first and second conductive patterns of the first and second circuit boards when the cover member is positioned at the closed position.

11. A connecting device, comprising;

a connector, including a first face, and a second face opposing said first face;

a first recess portion included in said first face;

a second recess portion included in said second face; and a terminal, a part of which extends through said first and second recess portions, wherein said first and second recess portions are adapted to receive first and second circuit boards; and wherein said terminal positions said first and second circuit boards at corresponding edges thereof and electrically connects said first and second circuit boards.

12. A connecting device as in claim 11, wherein the terminal is configured to be in contact with an outer peripheral edge portion of the first circuit board and an outer peripheral edge portion of the second circuit board.

13. A connecting device adapted to electrically connect a first circuit board and a second circuit board, the connecting device comprising:

a connector, having a first face and a second face opposite to said first face;

a first recess portion, formed on said first face and adapted to receive the first circuit board therein;

a second recess portion formed on said second face and adapted to receive the second circuit board therein;

a terminal, a part of which extends through said first and second recess portions; and a cover member, slidably attached to the connector and operable to fix the first and second circuit boards to the first and second recess portions, respectively;

wherein the terminal electrically connects the first circuit board and the second circuit board when the first circuit board and the second circuit board are fixed to the first recess portion and the second recess portion, respectively.

* * * * *